United States Patent [19]

Hayashi

[11] Patent Number: 4,896,134

[45] **Date of Patent: * Jan. 23, 1990**

[54] ARMORED SELF-CONTAINED OUTDOOR/INDOOR SIREN ASSEMBLY

[75] Inventor: Takatoshi Hayashi, Saitama, Japan

[73] Assignee: Kobishi Electric Co., Ltd., Tokyo, Japan

[ * ] Notice: The portion of the term of this patent subsequent to May 12, 2004 has been disclaimed.

[21] Appl. No.: 188,959

[22] Filed: May 2, 1988

[51] Int. Cl.[4] ..... G08B 3/00

[52] U.S. Cl. ..... 340/384 E; 340/384 R; 340/388; 181/194; 181/198; 116/137 R; 116/142 R

[58] Field of Search ..... 340/384 E, 388, 384 R; 181/152, 159, 198, 194; 116/137 R, 137 A, 142 R

[56] References Cited

U.S. PATENT DOCUMENTS

| | | | |
|---|---|---|---|
| 1,625,325 | 4/1927 | Macartney et al. | 181/194 |
| 1,644,795 | 10/1927 | Stevens | 181/194 |
| 1,772,645 | 8/1930 | Stevens | 181/194 |
| 2,558,278 | 6/1951 | Stone et al. | 181/194 |
| 4,210,223 | 7/1980 | Gillum et al. | 181/194 |
| 4,306,120 | 12/1981 | Klein | 381/156 |
| 4,310,833 | 1/1982 | Sakaguchi | 340/388 |
| 4,550,229 | 10/1985 | Hwang | 181/179 |
| 4,664,055 | 5/1987 | Hayashi | 340/388 |

*Primary Examiner*—Donnie L. Crosland
*Attorney, Agent, or Firm*—Keith D. Beecher

[57] ABSTRACT

An armored self-contained outdoor/indoor siren assembly which eliminates the need for an additional protective box and an additional tamper switch which are generally used in the prior art installations. The armored siren assembly of the invention consists of a rigid and strong cover member which forms a housing, and a number of horns mounted within the housing in coaxial nested relationshp with one another which not only form a sound chamber for the siren, but also form a protective means for the sound generating unit of the siren to prevent access to the sound generating unit by unauthorized persons. The cover of the assembly, as well as the various horns included in the housing, and the mounting brackets for the horns, may all be formed, for example, of rustproof diecast aluminum.

5 Claims, 3 Drawing Sheets

ARMORED SELF-CONTAINED OUTDOOR/INDOOR SIREN ASSEMBLY

BACKGROUND OF THE INVENTION

The siren assembly of the invention is of the type disclosed in U.S. Pat. No. 4,664,055 which issued May 12, 1987 in the name of the present inventor and which is assigned to the present assignee.

It is usual in the art prior to the assembly disclosed in U.S. Pat. No. 4,664,055 to mount burglar and fire alarms in boxes formed of steel, or other strong material. The purpose of the boxes is to protect the alarms from the elements and from tampering. It is usually necessary to equip such boxes with additional tamper switches which cause the alarm to be activated should anyone attempt to open the box.

However, such boxes and tamper switches represent additional expense. Accordingly, an objective of the present invention is to provide an armored housing for a siren alarm, or the like, which not only forms the sound chambers for the siren, but which also provides a weatherproof and tamperproof age for the assembly.

DETAILED DESCRIPTION OF THE ILLUSTRATED EMBODIMENT

Figure 2:
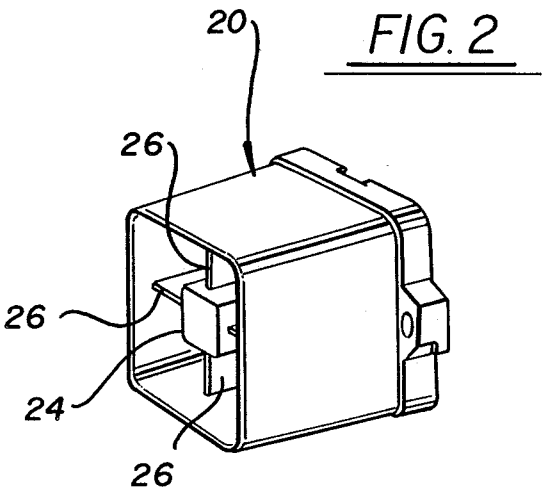
FIG. 2 is a perspective view of the armored self-contained siren alarm unit of the present invention in one of its embodiments.
Figure 1:
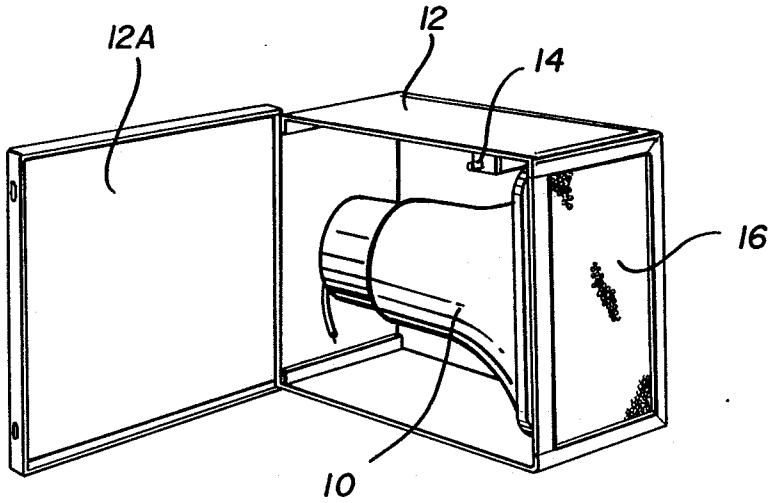
FIG. 1 (PRIOR ART)
FIG. 1 is a perspective representation of a typical prior art siren alarm mounted in a protective box.
Figure 4:
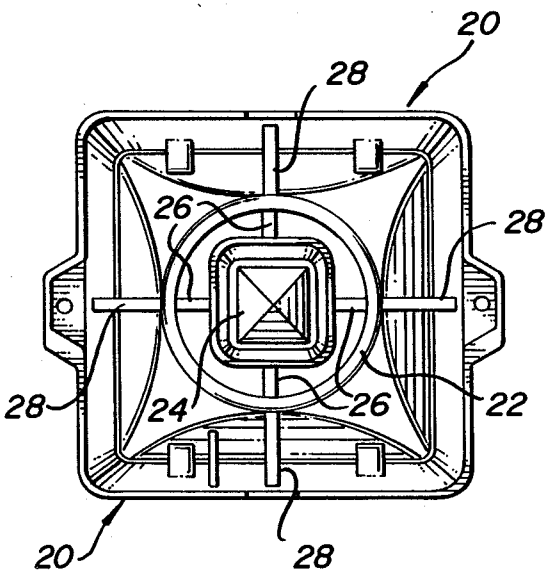
FIG. 4 is rear view of the unit of FIG. 2.
Figure 3:
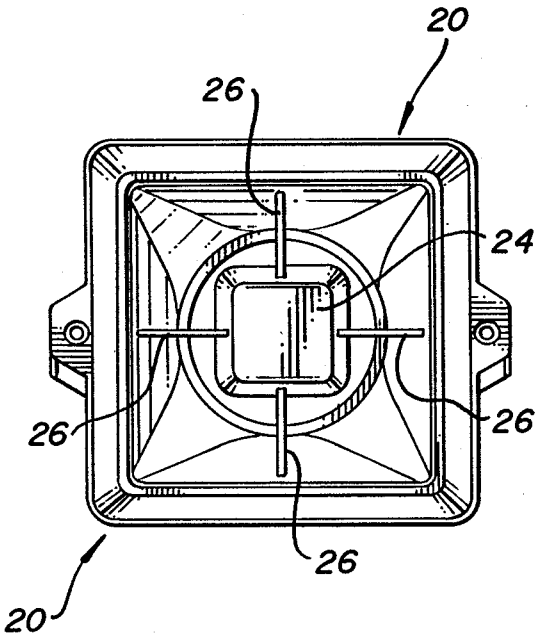
FIG. 3. is a front view of the unit of FIG. 2.
Figure 6:
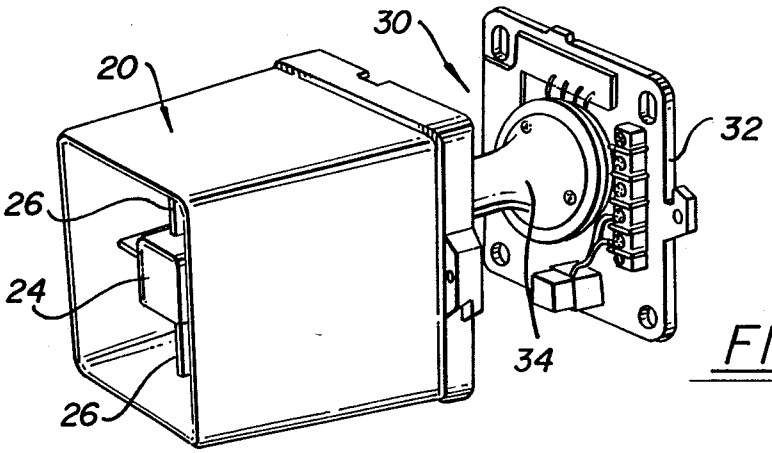
FIG. 6 is a perspective view of the cover and of the sound generating unit during assembly or disassembly, with the sound generating unit being partially displaced from the cover.

Prior to describing the preferred embodiment of the invention, reference is made to FIG. 1 which illustrates a typical prior art electrically activated siren alarm 10 which is mounted in a box 12. The box is formed of steel, or other appropriate strong and rigid material. A steel mesh grille 16 is provided at one end of the box so that sounds emanating from the siren alarm 10 may be freely transmitted to the surrounding space. The box 12 is provided with a cover 12A which, when closed, deactivates a tamper switch 14.

The purpose of the box 12 is to protect the alarm unit 10 from the elements, and also from tampering. Switch 14 closes whenever the cover 12A is opened, thereby activating the siren alarm 10 in the event that the cover is opened by an unauthorized person.

Although the box 12 and switch 14 are effective in performing their intended function, they represent an additional expense and add to the overall cost of the prior art assembly of FIG. 1. In accordance with the present invention, a siren alarm unit is constructed so that the unit itself forms a protective housing for its internal sound generating unit, thereby protecting the unit from tampering and also from the weather.

One embodiment of the invention is shown in FIGS. 2–7. The unit, as shown in FIGS. 2–7 includes a cover member 20 which is open-ended, and which has a generally square cross-sectional area. The cover 20 forms a housing in which the various components of the siren alarm are mounted.

Specifically, a first open-ended horn 22 is positioned within the housing formed by the cover member 20, and horn 22 is formed integral with the cover member at the common perimeter of the open front ends of the cover member and of the first horn. The first horn extends coaxially with the cover member 20 within the housing formed by the cover member toward the rear end of the unit, and the horn 22 converges radially inwardly toward its rear end. The open rear end of the horn 22 is displaced forwardly of the open rear end of the cover member 20.

Figure 7:
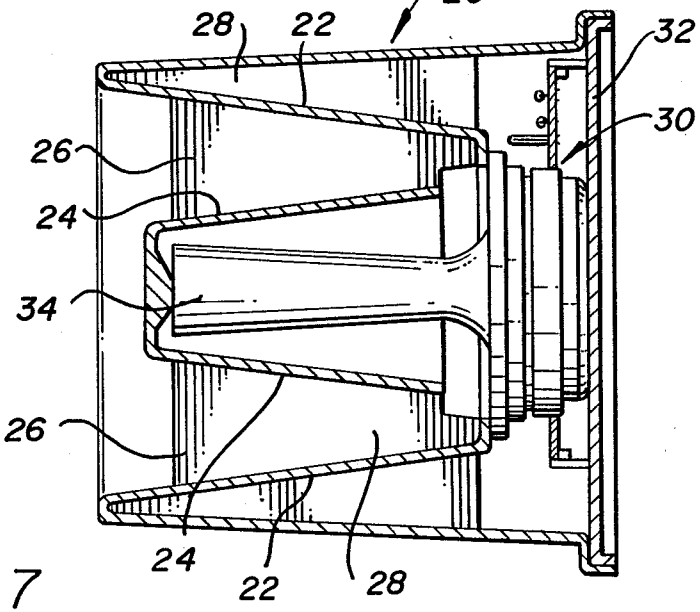
FIG. 7 is a sectional view of the assembly of FIG. 2.
Figure 5:
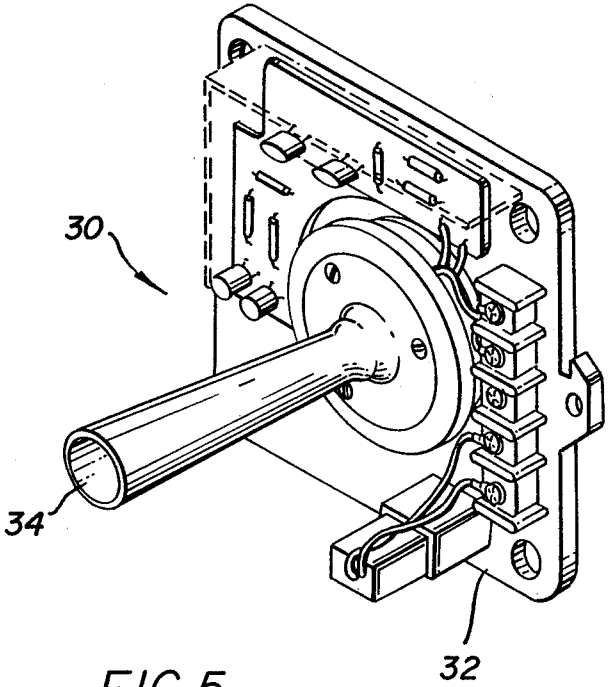
FIG. 5 is a perspective representation of a sound generating unit which is mounted within the housing formed by the cover of the unit of FIG. 2.

A second horn 24 is coaxially supported in nested relationship with horn 22 by a number of vanes 26. Horn 24 is closed at its forward end and open at its rear end, and as best shown in FIG. 7, converges from its rear end to its forward end. A second series of supporting vanes 28 are provided between the horn 22 and the cover 20.

The horns 24 and 22, the cover 20, and the vanes 26 and 28 are all preferably formed integral with one another and of a suitable strong and rigid material, such as diecast aluminum.

An electrically activated sound producing unit 30 is mounted on a base 32 which, in turn, is removably mounted on the rear end of cover 20 to form an enclosure for the cover. The sound producing unit includes a horn 34 which extends into the horn 24 in coaxial relationship therewith when the sound producing unit 30 is mounted in place in the housing of cover 20 by means of the base 32.

When the sound producing unit 30 is activated, the sound produced by the unit passes through horn 34 and into the sound chambers formed by horns 22 and 24 and out through the forward end of the assembly.

It will be appreciated that the horns 22 and 24, in addition to forming sound chambers for the unit 30 also provide a rigid and strong protection for the horn 34 and for the sound producing unit 30 mounted within the housing formed by the cover 20. Accordingly, there is no need to provide a separate box 12, or an additional tamper switch 14, as was the case with the siren alarm unit 10 of FIG. 1.

The invention provides, therefore, an armored self-contained siren alarm which is constructed to eliminate the need of an additional box, as was the case with the alarm 10 of FIG. 1, and which consists of a strong cover housing which forms the sound chamber for the unit, and which also serves as a rugged and strong protection for the internal components of the unit, preventing unauthorized access into the unit.

It will be appreciated that while a particular embodiment of the invention has been shown and described, modifications may be made. It is intended in the claims to cover all modifications which come within the true spirit and scope of the invention.

I claim:

1. A weatherproof and tamperproof alarm unit comprising: a cover member of strong and rigid armor material forming a housing having an open front end and an open rear end; a first horn of like strong rigid armor material having an open front end and an open rear end, said first horn being integrally connected to said cover member at the front open end of said housing and converging toward the rear end of said housing; a second horn of like strong rigid armor material having a closed front end and an open rear end and converging from its rear open end to its closed front end; means supporting said second horn coaxially within said first horn in radially spaced relationship therewith with the closed front end of said second horn positioned adjacent to the open front end of said housing and of said front horn to close the open front end of said housing; a base removably mounted on the open rear of said housing and forming an enclosure therefor; and an electrically activated sound generating unit mounted on said base and including a third horn extending coaxially into said second horn and diverging toward the closed end of said second horn in radially space relationship therewith.

2. The combination defined in claim 1, in which said supporting means comprises a plurality of radially extending supporting vanes formed of like strong rigid armor material.

3. The combination defined in claim 2, in which said cover member, said first and second horns, and said supporting vanes are all integral with one another.

4. The combination defined in claim 3, and which includes a further plurality of supporting vanes of like strong rigid armor material extending radially between said cover and said first horn and integral therewith.

5. The combination defined in claim 1, in which said housing has a square cross-section, in which said first horn has a circular cross-section, and in which said second horn has a square cross-section.

* * * * *